United States Patent [19]

Rachedi

[11] 4,398,524

[45] Aug. 16, 1983

[54] EXHAUST GAS RECIRCULATION SYSTEM

[75] Inventor: Shane H. Rachedi, Dearborn, Mich.

[73] Assignee: Ford Motor Company, Dearborn, Mich.

[21] Appl. No.: 286,302

[22] Filed: Jul. 24, 1981

[51] Int. Cl.[3] ..... F02M 25/06

[52] U.S. Cl. ..... 123/568

[58] Field of Search ..... 123/568

[56] References Cited

U.S. PATENT DOCUMENTS

| | | | |
|---|---|---|---|
| 3,641,989 | 2/1972 | Hill | 123/568 |
| 3,667,452 | 7/1972 | Nohira et al. | 123/571 |
| 3,880,129 | 4/1975 | Hollis, Jr. | 123/568 |
| 3,881,456 | 5/1975 | Nohira et al. | 123/571 |
| 3,974,807 | 8/1976 | Nohira et al. | 123/568 |
| 3,982,515 | 9/1976 | Bradshaw | 123/568 |
| 4,128,090 | 12/1978 | Aoyama | 123/568 |
| 4,178,898 | 12/1979 | Jidosha et al. | 123/568 |
| 4,186,698 | 2/1980 | Aoyama | 123/568 |
| 4,285,318 | 8/1981 | Yoneda et al. | 123/568 |

*Primary Examiner*—Wendell E. Burns

*Attorney, Agent, or Firm*—Robert E. McCollum; Clifford L. Sadler

[57] ABSTRACT

An EGR assembly of a sonic flow EGR valve and a fluid pressure actuated servo operated by air pressure modified by an air bleed device controlled in response to changes in carburetor venturi vacuum levels to provide EGR valve openings in proportion to engine air flow increases.

4 Claims, 5 Drawing Figures

EXHAUST GAS RECIRCULATION SYSTEM

This invention relates in general to an exhaust gas recirculation (EGR) system for an automotive type internal combustion engine. More particularly, it relates to a sonic flow EGR valve means operated by servo means that is modulated as a function of changes in carburetor venturi vacuum.

Many of the EGR systems in use today are of the so called backpressure control type. That is, they operate on the principle of establishing a constant pressure chamber upstream of the EGR valve in the exhaust manifold passage. The movement of the EGR valve is controlled as a function of changes in exhaust gas backpressure to maintain the chamber pressure constant by variably bleeding air into a control vacuum used to actuate the EGR valve to its various positions until the EGR valve moves to regulate the pressure in the control chamber to the constant value. The maximum rate of flow through the valve, therefore, will be determined by the maximum pressure differential between the exhaust backpressure and the control chamber pressure. Since the range of exhaust backpressure changes is relatively small compared to the range of intake manifold vacuum changes, the maximum flow rate will be limited. Also, since flow through the valve is not at sonic velocity, the rate of flow will not be constant at any one position of the valve. Examples of such systems are shown in U.S. Pat. Nos. 3,880,129, Hollis, 4,178,896, Horikoski et al, 4,128,090, Aoyama, and 4,186,698, Aoyama.

Some known constructions of EGR valves use carburetor venturi vacuum to control movement of the air bleed valve to provide an EGR rate of flow that is essentially proportional to the air flow through the engine. Others use engine driven air pump pressure as the EGR valve moving force.

An example of the latter type is shown in U.S. Pat. Nos. 3,881,456, and 3,974,807, Nohira et al, wherein above atmospheric pressure from an engine driven air pump controls the movement of an EGR valve in response to the changes in the control pressure in a constant pressure chamber upstream of the valve acting on an air bleed means.

In each of the above cases, the position of the EGR valve is a function of the regulatory movement of the EGR valve with exhaust gas backpressure changes to reestablish the control pressure chamber pressure as a constant. The rate of flow through the valve, therefore, will be limited by the diameter of the orifice or flow restrictor upstream of the EGR valve defining the control chamber.

Another construction in use today is one combining venturi vacuum and engine driven air pump pressure to provide an EGR valve opening proportional to engine air flow. Such a construction is shown in FIG. 6 in U.S. Pat. No. 3,877,452, Nohira et al, wherein a poppet type EGR valve is moved by air pump pressure controlled by an air bleed device that varies the air pump pressure as a function of changes in venturi vacuum level. However, as in the other examples, the gases do not flow through the EGR valve at sonic velocity and, therefore, the rate of flow is not a constant.

It is a primary object of this invention to provide an EGR valve assembly and system that provides a greater maximum rate of EGR flow that varies as a function of the pressure differential between engine exhaust backpressure and engine intake manifold vacuum; also, one that varies essentially proportional to engine air flow; and one having an EGR valve providing a constant rate of flow through the valve for each open position of the valve, and at a rate of flow that is independent of exhaust gas backpressure levels. Such an object is obtained by the use of a sonic flow EGR valve in which the rate of flow past the valve is maintained at sonic velocity over essentially the entire operating range of the engine. Sonic flow provides a constant pressure past the valve opening and therefore, a constant rate of flow. Accordingly, the rate of flow through the valve will vary in direct proportion to the area opening of the valve and will be independent of the pressure downstream of the valve. The rate of flow, therefore, is independent of exhaust gas backpressure levels. The rate of flow, therefore, is not dependent upon the maintenance of a constant pressure chamber upstream of the EGR valve as is the case in some of the prior art devices.

It is another object of the invention, therefore, to provide an EGR system that includes a sonic flow EGR valve that operates independently of exhaust gas backpressure, and one whose movement is modulated in accordance with changes in carburetor venturi vacuum to open in proportion to engine air flow requirements.

Various embodiments of the invention utilize engine driven air pump pressure or, alternatively, atmospheric air pressure as the force for opening the EGR valve, and a control vacuum chamber that is variably bled with atmospheric air as a function of changes in venturi vacuum level to vary the movement of the EGR valve.

The use of a control vacuum for the actuation of the EGR valve, in general, is known. For example, U.S. Pat. No. 3,641,989, Hill, shows in FIG. 3 a carburetor ported vacuum actuated EGR valve. However, it will be noted that in contrast to the constructions of this invention, the Hill construction does not utilize a sonic flow EGR valve, does not include an EGR valve that is modulated by the changes in venturi vacuum level, nor does it contain an air bleed device to provide the modulation described.

U.S. Pat. No. 3,982,515 shows a venturi vacuum controlled EGR valve assembly including an air bleed valve for modifying the movement of the EGR valve. However, in this case, the flow of gases through the EGR valve is not at sonic velocity and the rate of flow, therefore, is not constant at each position of the valve.

It is a still further object of the invention, therefore, to provide an EGR system that provides a constant rate of flow of EGR gases into the engine intake manifold as a function of the changes in a controlled vacuum modified in accordance with changes in engine carburetor venturi vacuum levels and independent of engine exhaust gas backpressure changes.

Other objects, features, and advantages of the invention will become more apparent upon reference to the succeeding detailed description thereof, and to the drawings illustrating the preferred embodiments thereof; wherein, FIG. 1 is a schematic illustration, with parts broken away and in section, of an exhaust gas recirculation system embodying the invention;

Figure 1:
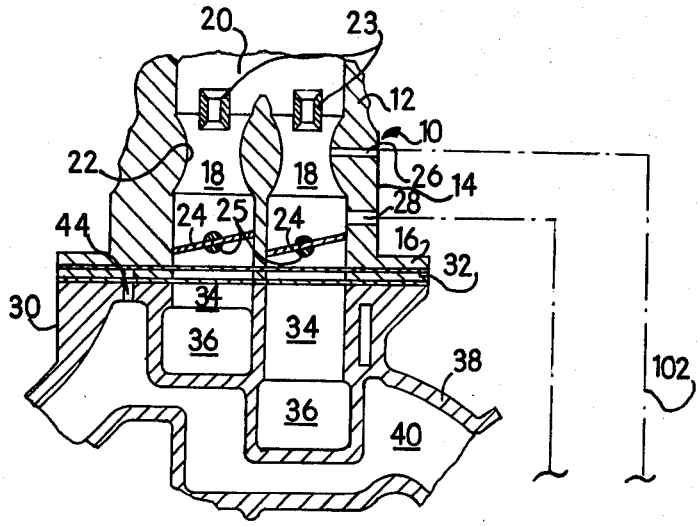

FIG. 1 illustrates a portion 10 of a two-barrel carburetor of a known downdraft type. It has an air horn section 12, a main body portion 14, and a throttle body 16, joined by suitable means not shown. The usual air/fuel induction passages 18 are provided open at their upper ends 20 to fresh air from an air cleaner, not shown, and connected at their lower ends to the engine intake manifold 30. Fixed area venturies 22 cooperate with boost venturies 23 through which the main supply of fuel is induced, by means not shown.

Flow of air and fuel through induction passages 18 is controlled by a pair of throttle valve plates 24 each fixed on a shaft 25 rotatably mounted in the side walls of the carburetor body.

The induction passages also contain first and second pressure sensing ports; that is, a venturi vacuum sensing port 26 and a so called exhaust gas recirculation (EGR) vacuum sensing port 28. The latter is adjacent the edge of the throttle valve in its closed position so as to be traversed by the edge as the throttle valve moves to open positions. This progressively exposes the port to manifold vacuum and thus provides a port vacuum level that varies as a function of throttle valve position.

The throttle body 16 is flanged as indicated for bolting to the top of the engine intake manifold 30, with a spacer element 32 located between. Manifold 30 has a number of vertical risers or bores 34 that are aligned for cooperation with the discharge end of the carburetor induction passages 18. The risers 34 extend at right angles at their lower ends 36 for passage of the mixture out of the plane of the figure to the intake valves of the engine.

The exhaust manifolding part of the engine cylinder head is indicated partially at 38, and includes an exhaust gas crossover passage 40. The latter passes from the exhaust manifold on one side of the engine to the opposite side beneath the manifold trunks 36 to provide the usual "hot spot" beneath the carburetor to better vaporize the air/fuel mixture.

Figure 2:
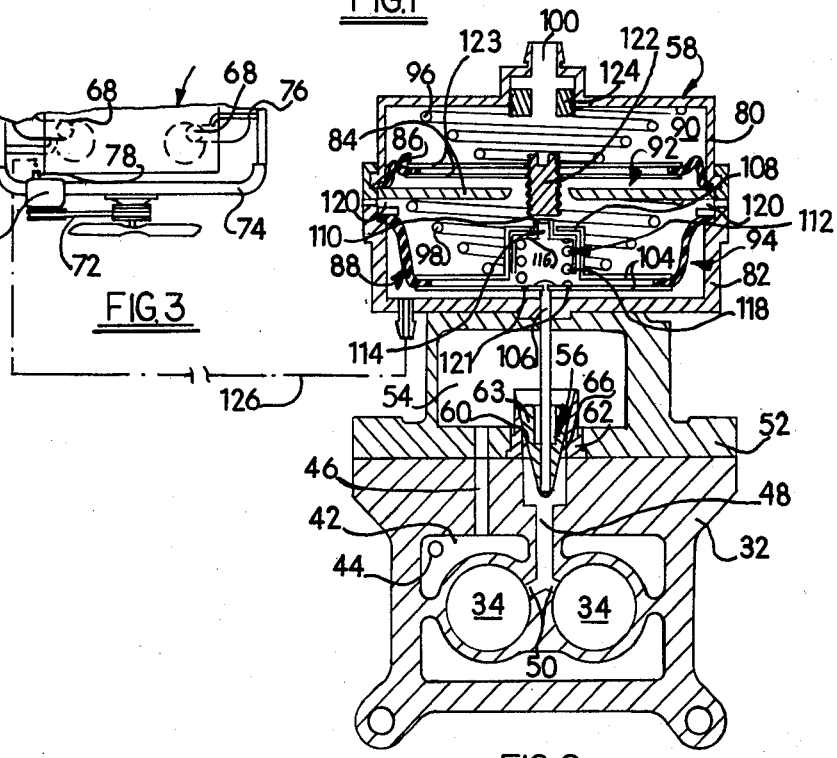
FIG. 2 is a cross-sectional view taken on a plane indicated by and viewed in the direction of the arrows 2—2 of FIG. 1.

As best seen in FIG. 2, the spacer 32 is provided with a worm-like recess 42 that is connected directly to crossover passage 40 by a bore 44, as seen in FIG. 1. Also connected to passage 42 is a passage 46 connected to a central bore or passage 48 communicating with the risers 34 through a pair of ports 50. Mounted to one side of the spacer is a cup-shaped boss 52 forming a chamber 54 through which passages 46 and 48 are interconnected.

To prevent the recirculation of exhaust gases at undesirable times, passage 48 normally is closed by an EGR valve 56 that is moved to an open position by a servo means 58. EGR valve 56 in this case is a sonic flow control valve, similar to that fully shown and described in U.S. Pat. No. 3,981,283, Kaufman. That is, the walls 60 of the valve seat nozzle 62 are shaped so as together with the conical like plug valve or pintle 63 form a convergent-divergent flow passage with sonic flow at the throat 66 between the two for each open position of the movable plug valve 56.

As seen in FIG. 2, the servo 58 consists of a two-piece housing 80, 82 that is divided by a central open partition 84. A pair of flexible annular diaphragms 86, 88 further subdivide each half into a vacuum chamber 90, an air pressure chamber 92 between the diaphragms, and a further air pressure chamber 94. Each of the diaphragms is edge mounted to the housing, with springs 96 and 98 biasing the diaphragms downwardly to their null positions shown.

The lower diaphragm 88 is sandwiched between a pair of washer-like retainers 104, the lower one having fixed thereto the stem 106 of sonic flow EGR valve 56. The upper retainer 104 is formed with a hat-shaped subhousing 108 having an opening or a hole 110 at its upper end. Slideably received within the subhousing 108 is an air bleed valve 112 having a protruding button end 114 and laterally extending sidewalls 116 shaped to mate with the internal surfaces of the subhousing 108. A light spring 118 normally biases the valve 112 against the subhousing to prevent the communication of air in chamber 92 to chamber 94. Chamber 92 in this case is vented to the atmosphere through a pair of openings 120 in housing 80. The lower retainer 104 for diaphragm 88 is apertured at 121 to subject the interior of subhousing 108 to pressure of the air in chamber 94. When air bleed valve 112 is moved downwardly against the force of spring 118, the air pressure in chamber 94 can then be bled by the lower atmospheric air pressure in chamber 92, thus decaying the signal force in chamber 94 that is used to control the movement of the EGR valve 56.

Air bleed valve 112 in this case is controlled by a plunger 122 adjustably mounted to a pair of retainers 123 secured to the upper or first diaphragm 86. Upward movement of the lower or second diaphragm 88 will move air bleed valve 112 against plunger 122. This will move the bleed valve downwardly against the force of spring 118 to thereby permit the bleed of above atmospheric pressure air in chamber 94 through the outlets 120. This will continue until the pressure in chamber 94 decays sufficiently to allow spring 98 to move diaphragm 86 downwardly and again allow the air bleed valve to close to stabilize the position of the EGR valve.

Plunger 22 is limited in its upward movement by a stop 124 that is adjustably mounted in the housing. It will be clear that adjustment of the position of plunger 122 and also stop 124 will provide a large number of maximum positions for upward movement of the plunger 122 and thereby permit various maximum opening positions of the EGR valve 56.

Housing 80 contains an upper opening 100 formed with an adapter for connection by suitable tubing 102 indicated in FIG. 1 to the venturi vacuum sensing port 26.

Figure 3:
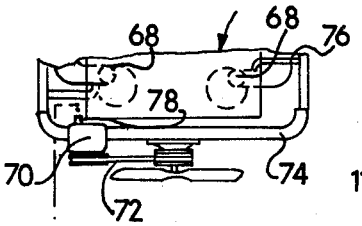
FIG. 3 is a schematic illustration of a portion of an engine.

The lower chamber 94 in this case is connected by tubing 126 to the outlet of an air pump shown in FIG. 3. FIG. 3 illustrates schematically a plan view of a portion of a conventional V-8 internal combustion engine having right and left banks of cylinders each with exhaust ports 68. Also shown is an air injection system consisting of an air pump 70 driven by the engine through a belt 72 to deliver air to each exhaust port through manifolding 74 and injections 76. The air combines with the unburned hydrocarbons and carbon monoxide that pass into the exhaust system and reduces them to $H_2O$ and $CO_2$. The air pump has a third outlet 78.

A constant supply of above-atmospheric pressure thus is applied to chamber 94, the pressure increasing with engine speed. It is the pressure in chamber 94 that is the signal force for moving the EGR valve 56. Since this is air pump pressure and independent of manifold vacuum, problems normally associated with low level manifold vacuum failing to operate EGR valves during times of acceleration are eliminated.

As stated previously, the valve 56 is a sonic flow contrl valve. That is, since the velocity and pressure of the flow through the throat of the C-D nozzle are constant for each position of the EGR valve, the rate of flow will also be constant for each position. Therefore, the rate of flow will vary in direct proportion to the opening area of the valve, and independently of exhaust gas backpressure or pressures adjacent the valve.

In this case, therefore, the air pump pressure in chamber 94 will cause movement of the EGR valve as a function of the engine speed; however, this will be modified by the air bleed valve 112 controlled in accordance with the position of the plunger 122 that will be located as a function of the changes in venturi vacuum. The latter varies as a function of engine air flow, steadily increasing as throttle valve 25 is progressively opened.

In operation, therefore, in brief, the engine idle speed positions of the parts are as shown in FIG. 2. With throttle valve 24 closed, venturi vacuum will be very low as will the air pump pressure of the low engine speed level. Accordingly, the upper diaphragm 86 will be positioned as shown in its downwardmost position or location with plunger 122 bearing against the stem 114 of air bleed valve 112 moving it to an open position relative to the subhousing 108. This permits the air pump pressure in chamber 94 to flow through the holes 121 and out through the open bleed valve hole 110 to be decayed by the atmospheric air pressure in chamber 92 to a level that is insufficient to move diaphragm 86 from the closed EGR valve position as shown.

An opening of the throttle valve will cause an increase in air flow through the carburetor induction passage and an increase in engine speed and, therefore, an increase in both the venturi vacuum and the engine air pump pressure. This results in the upper diaphragm 86 being pushed upwardly to release the air bleed valve 112 to its closed position. The air pump pressure in chamber 94, now increasing, no longer will decay and will move the lower diaphragm 88 upwardly. This will open the EGR valve 56 by an amount dependent upon the corresponding increase in venturi vacuum level in chamber 90. As stated previously, the upward movement of the air bleed valve 112 will continue until it contacts the plunger 122 in its new position established by the then higher level of venturi vacuum. The alternate opening and closing of air bleed valve 112 will then establish a new equilibrium position of the EGR valve 56 and thereby establish a new rate of flow of EGR gases through the EGR passage to the intake manifold of the engine.

Continued increased opening of the throttle valve 25 will cause increased opening of EGR valve 56 until the higher venturi vacuum acting on plunger 122 causes the plunger to engage stop 124. At this time, the EGR valve 56 will have opened a maximum amount permitting a maximum constant rate of flow through the valve. This rate will continue as a constant regardless of further increases in air pump pressure or venturi vacuum level. A suitable wide open throttle cut-off switch or valve could be provided if desired to cut off the venturi vacuum signal at a predetermined high engine output to thereby cause the air bleed valve mechanism to operate to effect a closing of EGR valve 56 at wide open throttle engine conditions.

Figure 4:
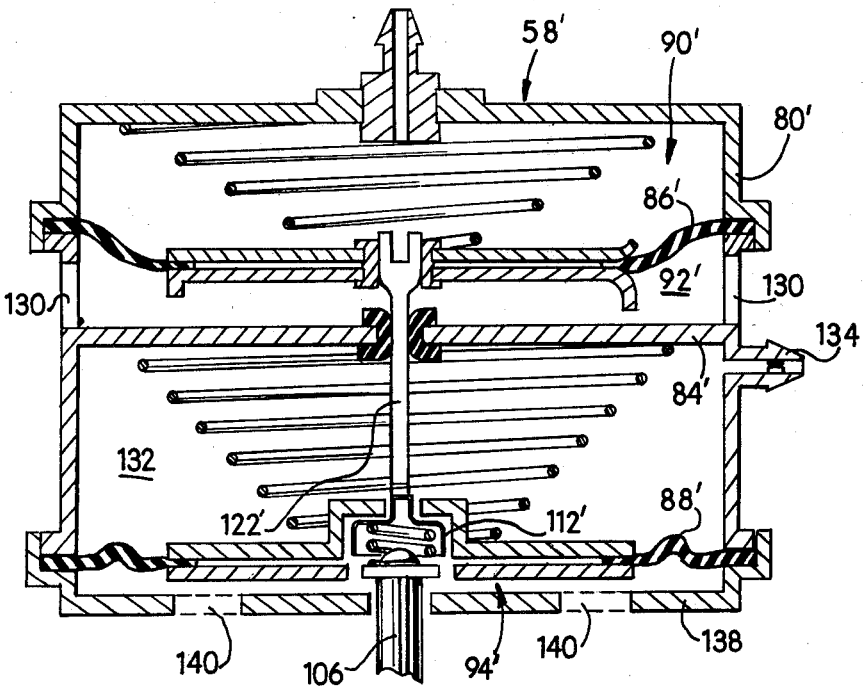
FIGS. 4 and 5 are enlarged cross-sectional views of modifications of details of FIG. 2 illustrating alternative embodiments of the invention.
Figure 5:
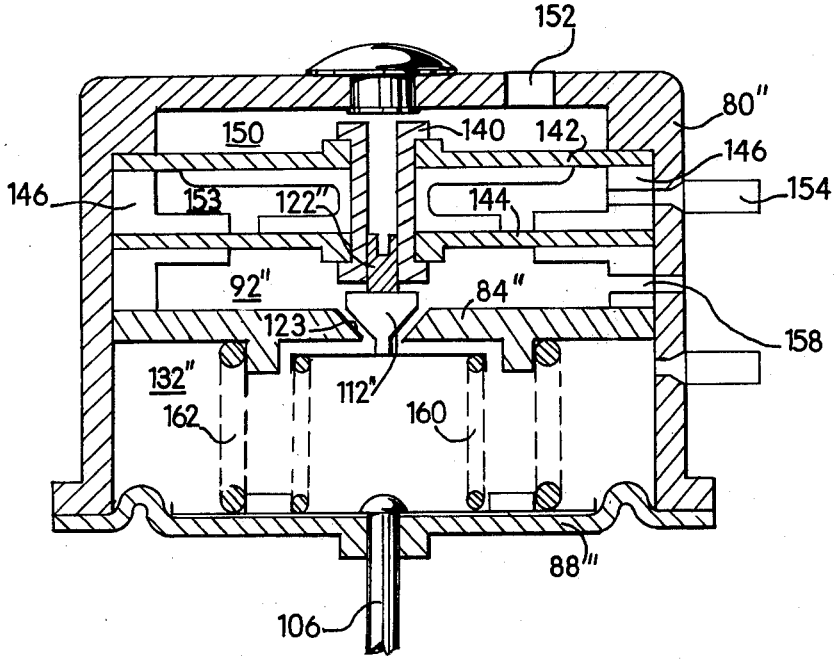

FIGS. 4 and 5 show alternate embodiments of the invention utilizing atmospheric air instead of air pump pressure as the signal force for moving the EGR valve. The atmospheric pressure chamber 92 of FIG. 1 is modified to be a vacuum control chamber to provide the pressure differential necessary for operation of the air bleed valve assembly in essentially the same manner as described in connection with FIG. 1.

More particularly, FIG. 4 shows a main three-piece housing 80' subdivided by a central partition 84' and two annular flexible diaphragms 86' and 88'. In this case, the central partition 84' seals the two diaphragms and chambers from one another so that upper diaphragm 86' partitions the upper chamber half again into a venturi vacuum chamber 90' and an air chamber 92'. Chamber 92' is vented to air at atmospheric pressure through a number of openings 130 in housing 80'. The sealing characteristic of the central partition 84' in this case provides a lower vacuum chamber 132 that may be connected by suitable tubing 134 through a constant vacuum type reservoir, not shown, to the second EGR port 28 shown in FIG. 1.

The lower wall 138 of housing 80 in this case is apertured to provide a number of air holes 140 to subject the lower side of diaphragm 88' to air at atmospheric pressure.

While the vacuum source in this case is indicated as being the second port 28, it will be clear that any suitable source of constant vacuum could be used, or that manifold vacuum plus a reservoir also could be used. All that is required is that there be two chambers at different pressure levels to provide the pressure differential necessary to operate the air bleed valve mechanism described similarly to that as in FIG. 1. An on-off, electrically controlled valve could be connected in the line to chamber 132 to schedule the input of vacuum as desired. In this case, the plunger 122' is extended as shown to protrude sealingly through the central partition 84' adjacent to the air bleed valve 112' in a manner similar to that shown in FIG. 1.

The operation of the servo means 58' of the FIG. 4 construction, therefore, is essentially the same as that shown in FIG. 1 with the exception that in this case, atmospheric air pressure in chamber 94' will be bled by the vacuum in chamber 132 to control the opening and closing of the air bleed valve assembly. The EGR valve 56, however, will open in the same manner and in response to the same venturi vacuum level as that indicated in FIG. 1.

FIG. 5 illustrates a still further modification of servo means 58 providing essentially the same operation as described in connection with the FIGS. 1 and 4 embodiments. More specifically, FIG. 5 shows a one-piece main housing 80'' divided by a central partition 84'' into upper and lower parts. The upper part in this case contains an assembly consisting of a tubular rigid support 140 to which is assembled a pair of annular flexible diaphragms 142 and 144. The latter are edge mounted into housing 80'' as shown with fixed separators 146 between. The upper diaphragm 142 with housing 80'' defines an air chamber 150 connected to air at atmospheric pressure through a vent 152. The space 153 between diaphragms 142 and 144 defines a vacuum chamber connected to venturi vacuum through an opening 154. The lower chamber 92'', defined between diaphragm 144 and central partition 84'' constitutes an air chamber connected to air at atmospheric pressure through a vent 158.

The plunger 122'' in this case is adjustably mounted within the hollow center of tubular support 140. It is part of the air bleed valve 112'', which cooperates with a matingly shaped hole 123 in partition 84''. The valve in this case engages a flat plate. A suitable feedback compression spring or positioning spring 160 is used to bias bleed valve 112″ upwardly as well as sense the position of the EGR valve 56.

The bleed valve moves vertically to control the flow of bleed air from atmospheric air chamber 156 into the control vacuum chamber 132″ defined between the partition 84″ and the lower diaphragm 88″. Chaber 132″ is, like the embodiment of FIG. 4, connected through a constant vacuum reservoir to any suitable source of vacuum such as, for example, the vacuum in port 28 adjacent the throttle valve 24, or manifold vacuum, or any other suitable source of vacuum. The requirement is that there be provided the pressure differential necessary to permit modified movement of EGR valve 56 in the same manner as described in connection with the embodiments of FIGS. 1 and 4.

The lower diaphragm 88″ in this case closes the open end of housing 80″. Its lower surface is subjected directly to the pressure of atmospheric air and has no holes or apertures for bleeding this pressure to modify the movement of the EGR valve. A spring 162 normally biases diaphragm 88″ downwardly as shown to allow the bleed valve to open.

In FIG. 5, venturi vacuum applied to chamber 153 between diaphragms 142 and 144 will, acting on the differential or unbalanced area between the two and the support 140 cause an upward movement of plunger 122″. At the same time, the control vacuum level in chamber 132″ will begin to increase as soon as the plunger permits bleed valve 112″ to assume a closed position, thus permitting upward movement of EGR valve 56 to a position dependent upon the value of the venturi vacuum. Thus, the action of this modification is essentially the same as that described in connection with the embodiment of FIG. 4. The upper movement of EGR valve 56 will continue until the venturi vacuum level has caused tubular support 140 to engage the maximum stop 180.

From the foregoing, it will be seen that the invention provides an EGR system consisting of a one-piece integral assembly of an EGR valve and a servo means to provide finite positions of an EGR valve as a function of changes in an air pressure signal force while being independent of engine exhaust gas backpressure, and at the same time modifying the action of the air pressure signal force as a function of the change in venturi vacuum level. It will also be seen that the use of a sonic EGR valve in the integral assembly described provides a constant rate of supply of EGR gas to the intake manifold for each open position of the valve, and a rate of flow that is independent of the downstream pressure conditions in contrast to devices in use today.

While the invention has been shown and described in its preferred embodiments, it will be clear to those skilled in the arts to which it pertains, that any changes and modifications may be made thereto without departing from the scope of the invention.

I claim:

1. An exhaust gas recirculation (EGR) system for use with an internal combustion engine having intake and exhaust manifolds, a carburetor induction passage having a venturi and a pressure sensing port adjacent the venturi for sensing the vacuum level therein, the system comprising;

an EGR duct connecting the gases from the exhaust manifold to the engine intake manifold, and a one-piece integral assembly of a spring closed sonic flow EGR valve means in the duct normally closing the duct to prevent recirculation of gases and movable to open positions in response to a signal pressure acting thereon and a fluid pressure actuated servo means connected to the valve means for moving the valve means in response to the signal pressure, the servo means comprising a housing having a pair of annular flexible diaphragm means spaced from one another and together partitioning the housing into a plurality of fluid chambers, means connecting a first one of the chambers at all times to the venturi port, means connecting a second diaphragm means to the EGR valve means, and means subjecting the second diaphragm means to the actuating signal pressure for actuating the EGR valve means, a second one of the chambers having an air bleed valve assembly operably associated therewith to bleed the actuating pressure at times, the assembly including an air vent and a spring closed air bleed valve movably associated with the vent to control flow through the same, a part of the assembly being movable with the first diaphragm means to control the bleed of air to control the movement of the EGR valve means as a function of the change in venturi vacuum;

the EGR valve means consisting of an essentially conical pintle mounted for a reciprocating movement into and out of a stationary cooperatively shaped nozzle valve seat to define convergent-divergent flow paths at all open positions of the pintle for the flow of exhaust gases therethrough, the valve means being so designed and constructed to provide sonic flow through the valve means over essentially the entire vacuum operating level of the engine to thereby establish a constant rate of flow of exhaust gases through the valve means at each open position of the valve means, the rates of flow through the valve means thereby varying solely as a function of the area opening of the valve means as determined by the position of the pintle in response to the change in venturi vacuum level controlling the signal pressure acting on the servo means and being independent of the pressure level variations adjacent the valve means;

the bleed valve including a subhousing secured to the second diaphragm means and having a hole therein defining the air vent, a valve movably mounted in the subhousing, spring means biasing the latter valve into the hole to block the same, the second diaphragm means also having a vent therethrough into the chamber defined by the subhousing connecting the signal pressure at all times to the subhousing chamber.

2. A system as in claim 1, the servo means including means venting the second chamber to atmosphere, the signal pressure comprising means subjecting the second diaphragm means to the discharge pressure of an air pump whose output varies as a function of engine speed, the second diaphragm vent interconnecting the air pump pressure to the atmospheric vent chamber, the spring closed bleed valve being mounted on the second diaphragm means for a movement into and out of the vent means to regulate the bleed of air pump pressure to the atmosphere to thereby control the movement of the EGR valve means, and plunger means secured to the first diaphragm means for movement in response to changes in venturi vacuum towards and away from the vent means to at times engage the bleed valve to control the bleed of air pump air and thereby the movement of the EGR valve means.

3. A system as in claim 1, including adjustable stop means located in the path of movement of the first diaphragm means in response to increasing venturi vacuum acting thereon to vary the maximum opening position of the EGR valve means to thereby determine the maximum rate of EGR flow.

4. A system as in claim 2, the plunger means being adjustably mounted to the first diaphragm means for operatively adjusting the initial opening position of the EGR valve means by adjusting the location at which the bleed valve initially opens in response to a venturi vacuum increase.

* * * * *